US008511287B2

(12) United States Patent
Hofbauer et al.

(10) Patent No.: US 8,511,287 B2
(45) Date of Patent: Aug. 20, 2013

(54) SUPERCRITICAL-STATE FUEL INJECTION SYSTEM AND METHOD

(75) Inventors: Peter Hofbauer, West Bloomfield, MI (US); Franz Laimboeck, Goleta, CA (US); Tyler Garrard, Buellton, CA (US)

(73) Assignee: EcoMotors International, Allen Park, MI (US)

( * ) Notice: Subject to any disclaimer, the term of this patent is extended or adjusted under 35 U.S.C. 154(b) by 310 days.

(21) Appl. No.: 12/877,766

(22) Filed: Sep. 8, 2010

(65) Prior Publication Data

US 2011/0057049 A1 Mar. 10, 2011

Related U.S. Application Data

(60) Provisional application No. 61/276,135, filed on Sep. 8, 2009.

(51) Int. Cl.
*F02G 5/04* (2006.01)

(52) U.S. Cl.
USPC ..... 123/543; 123/546; 123/547; 123/549; 123/557; 123/541

(58) Field of Classification Search
USPC ..... 123/41.08, 41.09, 179.15, 272, 304, 123/456, 525, 543, 546, 547, 549, 550, 557, 123/541, 570; 239/135; 137/334, 336; 701/112, 113
See application file for complete search history.

(56) References Cited

U.S. PATENT DOCUMENTS 3,515,106 A 6/1970 Verlinde
3,762,378 A 10/1973 Bitonti
3,807,377 A 4/1974 Hirschler, Jr.
4,318,623 A * 3/1982 Curtis ..... 366/144
4,458,655 A * 7/1984 Oza ..... 123/558
4,572,133 A 2/1986 Bago
4,670,938 A 6/1987 Fowlston
4,672,938 A 6/1987 Hoppie et al.
4,849,604 A 7/1989 Woolcott
4,870,943 A 10/1989 Bradley et al.

(Continued)

FOREIGN PATENT DOCUMENTS

DE 102006028639 A1 12/2007

OTHER PUBLICATIONS

Ahern, B. et al., Dramatic Emissions Reductions With a Direct Injection Diesel Engine Burning Supercritical Fuel/Water Mixtures, Society of Automotive Engineers, Paper No. 2001-01-3526, Sep. 24, 2001, Abstract only.

*Primary Examiner* — Stephen K Cronin
*Assistant Examiner* — Joseph Dallo
(74) *Attorney, Agent, or Firm* — Diana D. Brehob

(57) ABSTRACT

A fuel injector system for raising fuel to its supercritical state and injecting the supercritical-state fuel to the combustion chamber of an internal combustion engine is disclosed. A plurality of injector embodiments provides alternative ways to heat the pressurized fuel to its supercritical state. Injection of supercritical fuel into the combustion chamber is known to improve fuel entrainment and reducing ignition delay to thereby increase combustion rate, which leads to an increase in fuel efficiency. According to some embodiments, the system provides for preventing coking that may otherwise occur in an exhaust gas heat exchanger used for preheating the high pressure fuel. In other embodiments, engine cold start assistance is provided by storing pressurized, heated fuel in an insulated container.

21 Claims, 5 Drawing Sheets

(56) References Cited

U.S. PATENT DOCUMENTS

| | | | | |
|---|---|---|---|---|
| 5,163,397 | A | 11/1992 | Pien | |
| 5,235,954 | A * | 8/1993 | Sverdlin | 123/447 |
| 5,690,080 | A | 11/1997 | Pelgrim et al. | |
| 5,694,906 | A | 12/1997 | Lange et al. | |
| 6,010,544 | A | 1/2000 | Haldeman et al. | |
| 6,213,103 | B1 * | 4/2001 | Kalla et al. | 123/549 |
| 6,276,347 | B1 | 8/2001 | Hunt | |
| 6,390,076 | B2 | 5/2002 | Hunt | |
| 6,513,733 | B1 * | 2/2003 | Lambert | 239/533.1 |
| 6,612,508 | B2 * | 9/2003 | Lambert | 239/533.12 |
| 6,789,745 | B1 * | 9/2004 | Babin et al. | 239/135 |
| 6,868,668 | B2 * | 3/2005 | Suzuki | 60/286 |
| 7,070,126 | B2 * | 7/2006 | Shinogle | 239/584 |
| 7,249,596 | B2 | 7/2007 | Pellizzari et al. | |
| 7,444,230 | B2 | 10/2008 | Cheiky | |
| 7,488,357 | B2 | 2/2009 | Tavlarides et al. | |
| 7,546,826 | B2 | 6/2009 | Cheiky | |
| 7,694,664 | B1 * | 4/2010 | Sims, Jr. | 123/456 |
| 2001/0037795 | A1 * | 11/2001 | Stieler | 123/456 |
| 2002/0152998 | A1 * | 10/2002 | Katayama et al. | 123/541 |
| 2004/0065307 | A1 * | 4/2004 | Fiveland et al. | 123/552 |
| 2005/0193994 | A1 * | 9/2005 | Rigney | 123/549 |
| 2005/0199747 | A1 * | 9/2005 | Roarty | 239/135 |
| 2005/0269426 | A1 * | 12/2005 | Cho | 239/533.2 |
| 2006/0042565 | A1 * | 3/2006 | Hu | 123/3 |
| 2006/0151627 | A1 * | 7/2006 | Shafer et al. | 239/88 |
| 2006/0254133 | A1 * | 11/2006 | Rudolph et al. | 44/605 |
| 2007/0144490 | A1 * | 6/2007 | Serra et al. | 123/458 |
| 2007/0221647 | A1 * | 9/2007 | Walker et al. | 219/270 |
| 2007/0221874 | A1 * | 9/2007 | Hornby et al. | 251/129.09 |
| 2007/0227492 | A1 | 10/2007 | Cheiky | |
| 2007/0227493 | A1 | 10/2007 | Cheiky | |
| 2007/0227494 | A1 | 10/2007 | Cheiky | |
| 2007/0235086 | A1 * | 10/2007 | Hornby et al. | 137/334 |
| 2007/0235569 | A1 * | 10/2007 | Hornby et al. | 239/585.1 |
| 2007/0283927 | A1 * | 12/2007 | Fukumoto et al. | 123/445 |
| 2008/0022965 | A1 | 1/2008 | Bysveen et al. | |
| 2009/0133674 | A1 * | 5/2009 | Lee et al. | 123/527 |

* cited by examiner

SUPERCRITICAL-STATE FUEL INJECTION SYSTEM AND METHOD

CROSS-REFERENCE TO RELATED APPLICATIONS

This application claims the benefit of U.S. provisional application Ser. No. 61/276,135 filed 8 Sep. 2009.

TECHNICAL FIELD

The present disclosure is related to the field of internal combustion engines and more specifically to improvements in fuel injection systems employed in such engines.

BACKGROUND

Several attempts have been made to provide supercritical-state fuel into the combustion chambers of internal combustion engines to obtain greater fuel efficiency through reduced ignition delay and more complete combustion, while using the improved EGR tolerance to reduce NOx emissions.

Supercritical-state fluid occurs when temperature and pressure reach a point where the fluid is neither a pure gas nor a pure liquid. Above the supercritical point the supercritical-state fluid can have properties that look more like a gas than a liquid, or can have properties that look more like a liquid than a gas, depending on the compound and the temperature and pressure surrounding the compound.

High pressure (over the critical point) creates high density. In an internal combustion engine, high density fuel allows for the creating of sprays with high kinetic energy to form a plume that promotes entrainment and mixing with air and a more complete and fast combustion with good air utilization.

Phase diagrams for CO.sub.2 are shown in FIGS. 1 and 2. In the pressure-temperature phase diagram of FIG. 1, the boiling boundary line 500 separates the gas and liquid regions and ends at the critical point 502, where the liquid and gas phases disappear to become a single supercritical phase. The triple point 506 is a temperature and pressure condition at which all three phases coexist. The density-pressure phase diagram for CO.sub.2, in FIG. 2 allows additional observations. At well below the critical temperature, e.g. 280 K, as the pressure increases, the gas compresses and eventually (at just over 40 bar) condenses into a much denser liquid, resulting in the discontinuity in the line 512 (vertical dashed line) under the liquid-vapor dome. The result is two phases in equilibrium: a dense liquid (with the density indicated at the upper end of the dashed line) 514 and a low density gas (with the density indicated at the lower end of the dashed line) 516. As the critical temperature is approached (curve 518 is the isotherm at 300 K), the density of the gas at equilibrium becomes denser, and the density of the liquid becomes lower. At the critical point 520, (304.1 K and 7.38 MPa (73.8 bar)). There is no difference in density, and the 2 phases become one fluid phase. Thus, above the critical temperature, e.g., 310 K shown as line 522, a gas cannot be liquefied by pressure. At slightly above the critical temperature (310K), in the vicinity of the critical pressure, the density line is almost vertical. A small increase in pressure causes a large increase in the density of the supercritical phase. Many other physical properties also show large gradients with pressure near the critical point, e.g. viscosity, the relative permittivity and the solvent strength, which are all closely related to the density. At higher temperatures, the fluid starts to behave like a gas, as can be seen in FIG. 2. For carbon dioxide at 400 K, the density increases almost linearly with pressure, line 524.

In Table 1 below, it can be seen that the range of density, viscosity and diffusivity for various fluids in their gas and liquid phases have different ranges of properties when the fluids reach their supercritical states.

TABLE 1

| | Density ($kg/m^3$) | Viscosity (cP) | Diffusivity ($mm^2/s$) |
|---|---|---|---|
| Gases | 1 | 0.01 | 1-10 |
| Supercritical fluids | 100-1000 | 0.05-0.1 | 0.01-0.1 |
| Liquids | 1000 | 0.5-1.0 | 0.001 |

Additionally, there is no surface tension in a supercritical-state fluid, since there is no liquid/gas boundary. A change in pressure and temperature of the fluid can allow one to "tune" the fluid to be more liquid or more gas like. Solubility tends to increase with density of the fluid when held at a constant temperature potentially making solubility another important property of supercritical state fluids. Solubility of material in fluid is another important property of supercritical-state fluids, since solubility tends to increase with density of the fluid when held at constant temperature. Since density increases with pressure, solubility increases with temperature. However, close to the critical point (520 in FIG. 2), the density can drop sharply with a slight increase in temperature. Therefore, close to the critical temperature, solubility often drops with increasing temperature, then rises again. Supercritical-state fluids are completely miscible with each other; thus, a single phase can be guaranteed for a mixture when the critical point of the mixture is exceeded. The critical point of a binary mixture can be estimated as the arithmetic mean of the critical temperature and pressures of the two components. For greater accuracy, the critical point can be calculated using equations of state, such as the Peng-Robinson equation or group contribution methods. Other properties such as density can also be calculated using equations of state.

SUMMARY

The present disclosure provides a fuel injector system in which supercritical-state fuel, such as super-critical state diesel fuel, is injected into the combustion chamber of an internal combustion engine. An arrangement in which the injector is coupled to the combustion chamber so that the fuel is injected directly in the combustion chamber is typically referred to as a direct-injection system.

In one embodiment, the fuel used to hydraulically activate the injector is separated from supercritical-state fuel that is injected into the combustion chamber of an internal combustion engine.

In an embodiment, fuel is heated to the super-critical state by use of one or more glow plugs immediately preceding the injector.

In another embodiment, fuel is heated to be super-critical state within the injector by electrical induction.

In one embodiment, the supercritical-state fuel is preheated in an exhaust gas heat exchange system prior to being heated to its supercritical-state.

In one embodiment, electric energy is provided by an exhaust gas thermo-electric generator and the electric power heats the fuel by glow plugs or induction heating upstream of or in the injector(s) to arrive at supercritical state.

In one embodiment, cooling of the preheated and supercritically heated fuel is accomplished immediately following operational shut down of the internal combustion engine.

In one embodiment, storage of a quantity of preheated fuel is maintained immediately following operational shut down of the internal combustion engine to be available to the injectors upon the next start up of the engine.

Although FIGS. 1 and 2 relate to $CO_2$, similar graphs can be determined for any material, including blends such as fuels including a range of hydrocarbons. Supercritical-state conditions for typical hydrocarbon blends are achieved at or above 570 K and 50 bar pressure. Ambient temperature fuel is pressurized by the high-pressure injection pump.

Injectors of the present disclosure are configured to reduce heat losses and radiation by reducing metal volume heat sink, thermal insulation within Injector body, keep hydraulic amplification fuel and fuel return line cold, all by e.g. ceramic insulation.

In one embodiment temperature control of the exhaust gas heat exchanger is achieved through hot soak scavenging to avoid coking.

This disclosure involves improvements to any internal combustion engine, including spark-ignition and compression-ignition engines, as examples. One non-limiting example internal combustion engine is opposed-piston, opposed-cylinder (OPOC) engine described and claimed in U.S. Pat. Nos. 6,170,443; 7,434,550; and 7,578,267 that are incorporated herein by reference.

Key features of the disclosed embodiments include fuel injectors that are configured to inject fuel into the combustion chamber while in its supercritical-state. The use of supercritical-state fuel facilitates short ignition delay and fast combustion thereby avoiding emissions of unburned fuel due to quenching at cylinder walls and in combustion chamber crevices. Because the combustion rate is very fast with supercritical-state fuel, droplet diffusion combustion is substantially eliminated. Fast combustion yields a high rate of pressure rise that can cause undesirably high levels of noise, but higher thermal efficiency of the engine cycle. In conventional engines, the noise may be troublesome. However, in an OPOC engine, very little noise is transmitted outside the engine due to the lack of a cylinder head.

Also, advanced thermal management techniques are utilized to prevent coking during the cool-down period following engine operation.

A fuel injector is disclosed that can provide supercritical-state fuel to the combustion chamber of an internal combustion engine.

In one embodiment, the fuel injector is maintains separation between fuel used to provide hydraulic operation of the fuel injector and the supercritical-state fuel that is injected into the engine.

According to an embodiment of the present disclosure, a fuel injector is provided that receives supercritical-state fuel from a heat source external to the injector and isolates supercritical temperatures from the actuation mechanism of the injector.

In yet another embodiment of the present disclosure, a fuel injector is provided that receives fuel from a source preheated to a temperature that is less than the supercritical-state and heats the preheated fuel to a supercritical state within the injector prior to being injected into the internal combustion engine.

In yet another embodiment of the present disclosure, a fuel injector is provided in which fuel is heated to a supercritical state by the application of an electrical induction field.

In yet another embodiment of the present disclosure, a fuel injector is provided in which the fuel is heated to a supercritical state within the injector by the application of an electrical induction field where the electric power is transmitted by a transformer coil.

In some embodiments, the fuel injector system provides cooling of the injectors immediately following stopping the operation of the associated engine.

In yet other embodiments, the fuel injector system provides cooling to fuel preheating elements following stopping the operation of the associated engine.

In yet another embodiments of the present disclosure, a fuel injector is provided that captures and stores a quantity of preheated fuel immediately following stopping the operation of the associated engine for delivery to the injectors upon the next start up of the engine.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations.

Figure 1:
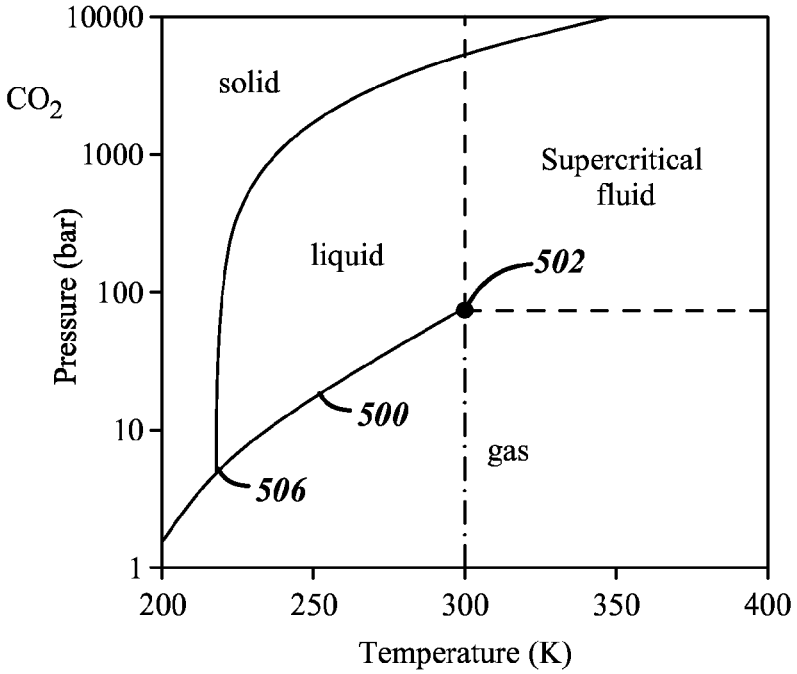
FIG. 1 is plot of temperature vs. pressure for $CO_2$ that illustrates the various phase boundaries, including the supercritical-state.
Figure 2:
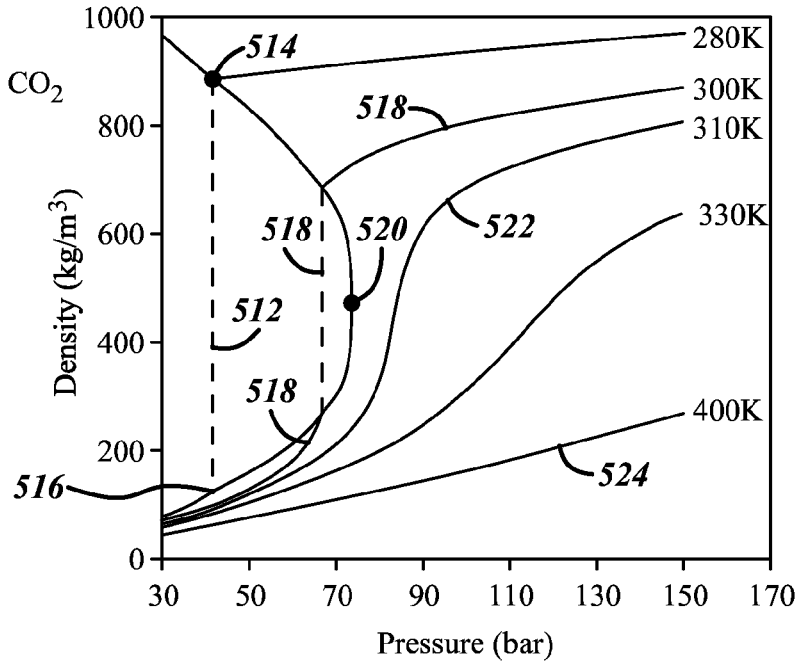
FIG. 2 is a plot of pressure vs. density for CO2 showing several isotherms to illustrate the dramatic changes in density that are available for particular temperatures in the supercritical state.
Figure 3:
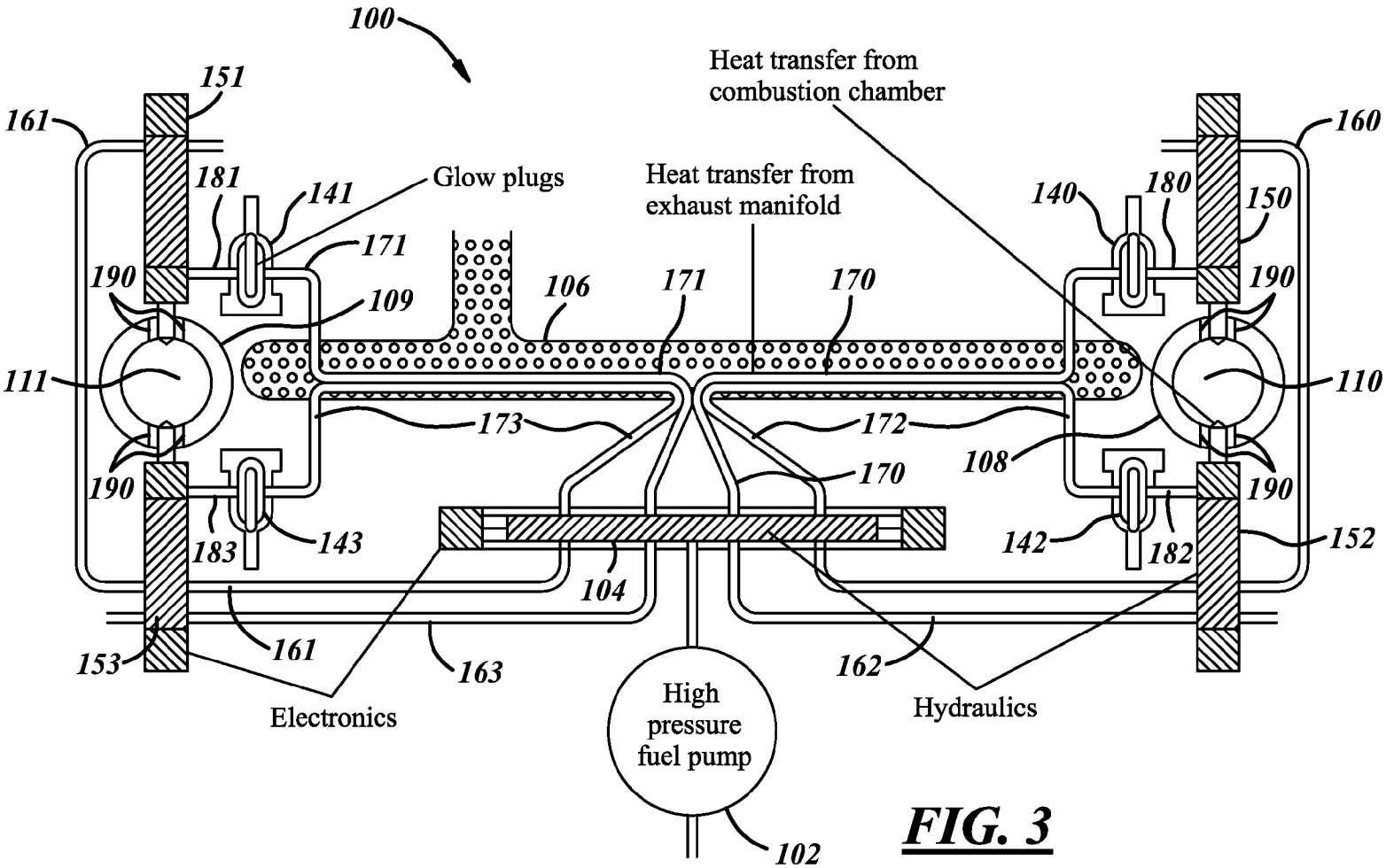
FIG. 3 is a conceptual illustration showing a preheating and supercritical-state heating system embodiment of the present disclosure.

FIG. 3 illustrates a fuel-injection system 100 in which fuel is raised to its supercritical-state and introduced into the combustion chambers 110 and 111 of cylinders 108 and 109 respectively, for combustion. In this embodiment, system 100 is shown associated with opposing cylinders 108 and 109 of a single OPOC engine module, as shown and described in the above "incorporated by reference" patents.

In this embodiment, which operates with a compression ignition diesel process, can be used with any liquid fuel in super critical phase. Each combustion chamber has a pair of fuel injectors mounted in opposition on the cylinders. Injectors 150 and 152 are mounted on cylinder 108 and injectors 151 and 153 are mounted on cylinder 109. Each injector receives heated fuel via a high pressure line (180, 182, 181 and 183) directly from glow plug heat chambers 140, 142, 141 and 143, respectively. In an alternative embodiment, only one injector per cylinder is provided. In yet another embodiment, a port fuel injector is provided, such as in a spark-ignition application.

A high pressure fuel pump 102 provides fuel to the hydraulic portions of the injectors in a conventional manner through a high pressure, low temperature common rail 104. Line 160 provides a fuel connection from common rail 104 to the hydraulic actuation portion of injector 150. Likewise, line 162 connects to injector 152, line 161 connects to injector 151 and line 163 connects to injector 153. Common rail 104 also provides fuel in fuel lines 170, 172, 171 and 173 through an exhaust gas heat exchanger 106 to glow plug heat chambers 140, 142, 141 and 143, respectively.

During the time fuel is flowing through the fuel lines within the exhaust gas heat exchanger 106, heat from exhaust gases is transferred to the fuel and serves to preheat the fuel to a temperature below that which is necessary to reach supercritical state at the internal pressure of the respective fuel lines. Preheated fuel then flows into glow plug heat chambers 140, 142, 141 and 143 as demanded through operation of the individual injectors. Each glow plug heat chamber transfers energy to the fuel to cause it to enter its supercritical state prior to entering the injector and being sprayed into the combustion chamber. Although not shown, several sensors are included to monitor the pressure and temperature of the fuel at various locations within the system to allow for adjustments, to determine the injected fuel is in its supercritical state.

Figure 4:
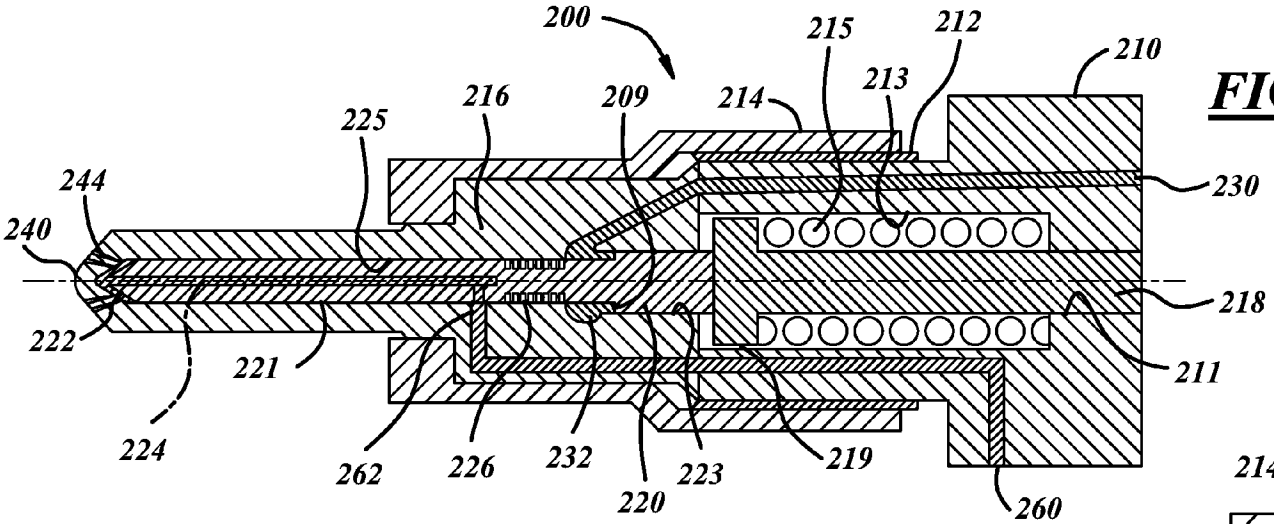
FIG. 4 is a cross-sectional view of a fuel injector according to the present disclosure.
Figure 5:
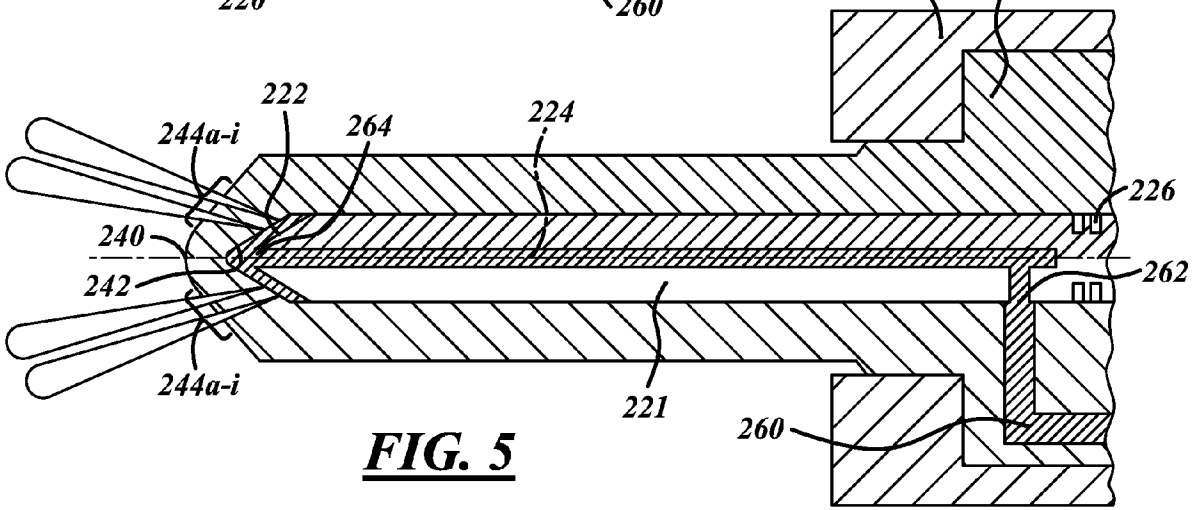
FIG. 5 is an enlarged cross-sectional view of the injector needle/nozzle end of the injector shown in FIG. 4.

FIGS. 4 and 5 provide cross-sectional plan views of a fuel injector embodiment. The injector 200 contains an upper body 210 having a lower external thread portion 212 and an internal set of bores 211 and 213. Upper bore 211 is configured to allow shaft 218 of injector needle 220 to move in a longitudinal motion. Lower bore 213 is larger than and in axial communication with upper bore 211. Lower bore 213 serves to contain a biasing spring 215 and spring flange 219 that extends laterally from shaft 218.

A lower body 214 is threadably connected to upper body 210 and provides sealed support to injector needle housing 216. Needle housing 216 contains an inner bore 223 that is in communication with and larger than a lower inner bore 225. An actuation chamber 232 is formed in inner bore 223 and is in fluid communication with a hydraulic actuation passage 230. Injector tip 240 extends into the combustion chamber of an engine and a plurality of nozzle apertures 244 are provided at injector tip 240. The internal portion of bore 225 in tip 240 contains a conical or concave needle seat 242 which is configured with a circular sealing element to mate with a corresponding sealing element on the conical or convex tip 222 of injector needle 221.

Injector needle 221 contains an actuation shoulder 209 adjacent actuation chamber 232 onto which hydraulic pressure acts to assist the movement of the needle. Lower down on needle 221, an injection passage 224 is provided that runs from an opening 262 in the side wall of needle 221 to needle tip 222 and provides an opening 264 through which fuel is delivered to nozzles 244 when needle 221 is retracted. A fuel passage 260 is formed in body 210 to deliver fuel to side opening 262 of injection passage 224.

A labyrinth cut 226 in injector needle 221 above the location of injection passage 224 and below actuation chamber 232 functions to insulate, by restricting the flow of heat from supercritical-state fuel present in injection passage 224 from migrating into actuation chamber 232. Allowing the actuation fuel to flow in and out of actuation chamber 232 provides additional temperature maintenance in chamber 232.

Although not shown in FIGS. 4 and 5, hydraulic passage 230 extends from a conventional hydraulic actuation control that provides increased pressure in passage 230 which in turn acts on shoulder 209 to assist electromagnetically actuated movement shaft 218 and needle 221 against the normally closed biasing pressure of spring 215.

In operation, fuel is heated to its supercritical state, as for example in FIG. 3, and delivered under pressure to fuel passage 260. Injector needle 221 is shown in both FIGS. 4 and 5 to be in its retracted and open position so that face of needle tip 222 is spaced from needle seat 242, allowing supercritical-state fuel to be forced through nozzles 244*a-x* and into the combustion chamber. At the end of the injection period, the hydraulic pressure in chamber 232 is reduced and the injector controller releases shaft 218 to allow needle 221 to move longitudinally towards tip 240. By the action of biasing spring 215 on flange 219, the face of needle tip 222 abuts needle seat 242 and nozzles 244 become closed. Supercritical-state fuel remains in injection passage 224 until the next injection cycle.

Figure 6:
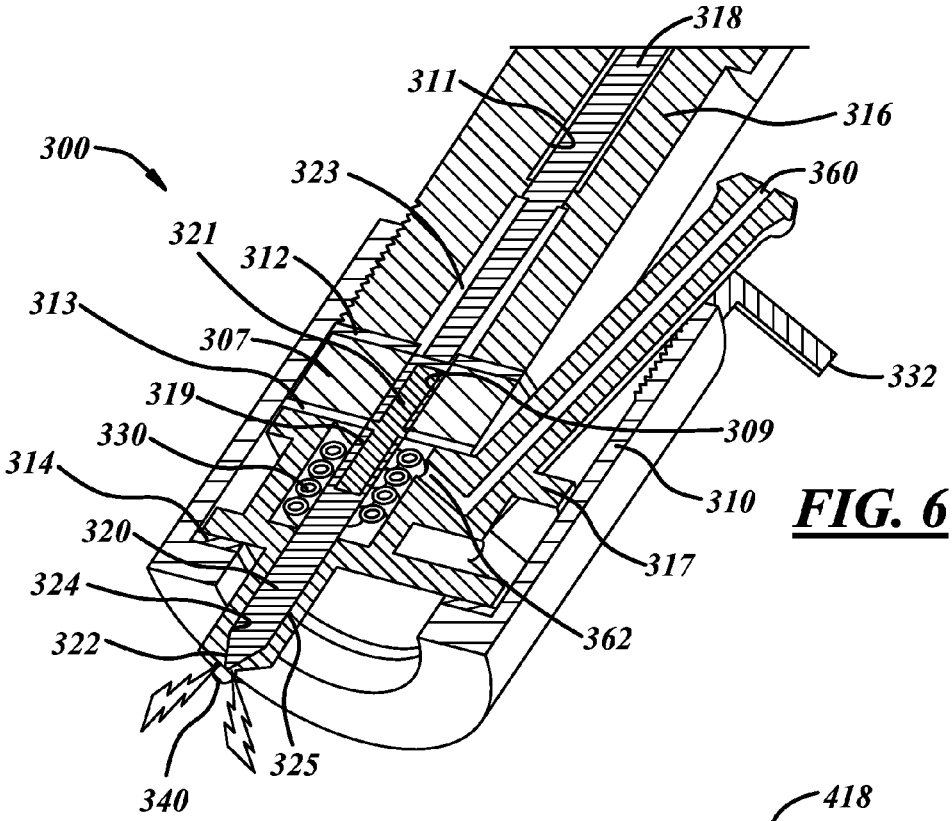
FIG. 6 a cross-sectional view of another embodiment of a fuel injector utilizing induction heating according to the present disclosure.

Another embodiment of a supercritical injector 300 is shown in FIG. 6 that utilizes electrical induction to heat fuel within the injector prior to being injected into the combustion chamber in its supercritical state. Elements of injector 300 include an upper sleeve body 316 that is threaded or otherwise sealingly connected to a lower housing 310, an intermediate body element 307 and a lower needle housing 317. Upper sleeve body 316 contains a central bore 311 for supporting upper injector needle shaft 318. A hydraulic actuation chamber 323 is below bore 311 to allow unheated fuel to be employed as hydraulic fluid. Unheated fuel is introduced into hydraulic actuation chamber 323 in a conventional manner to assist a conventional electromechanical actuator to operate the movement of injector needle 318 at predetermined portions of the injection cycle. Lower needle housing body 317 is positioned at the lower end of injector 300 and contains a heating chamber 319 that surrounds a lower portion of injector needle 320. Heating chamber 319 receives preheated fuel from a preheating source through fuel passage 360. (See FIGS. 3 and 8 for examples of preheating sources.) Fuel passage 360 has an open end 362 that is in communication with heating chamber 319. Grooves or loose spacing 325 between needle 320 and bore 324 in the lower portion of lower needle housing body 317 allow heated fuel from heating chamber 319 to enter spray nozzle portion 340 of injector 300, when needle tip 322 is retracted during its injection cycle.

In this embodiment, induction heating of fuel to its supercritical state is achieved by the use of an induction coil 330 mounted within heating chamber 319 to surround needle 320. Induction coil 330 is connected to wires 332. When connected to an electrical source, via wires 332, induction coil 330 generates an electrical field that induces heat in the portion of injection needle 320 that is within heating chamber 319. Induction occurring in the range of 4 kHz has been found to provide adequate heating. Fuel within heating chamber 319 and forced alongside needle 320 towards nozzle 340 in grooves or spacing 325 is heated by its contact with the outer surface of needle 320 to its supercritical state just before it reaches spray nozzle portion 340.

An insulator 321 is contained within needle 320 that is disposed within bore 309 to resist the migration of heat, from the lower part of needle 320 that is subjected to induction heating, to the upper portion. Other insulating sheaves 312, 313 and 314 (in one non-limiting example, ceramic) are provided between body and housing elements to help contain the heating necessary to place the fuel in its supercritical state.

Since the injector components are subjected to high heat during engine operation, there may be a danger of coking after the engine is stopped and the injector components are subjected to hot soak and the fuel is stationary in the injector. The embodiment of FIG. 6 is shown to employ tubular coils 330 to allow unheated fuel to be pumped there-through when the engine is shut off. This provides an immediate cool-down effect to heating chamber 319 as well as the other injector components that are subjected to supercritical temperatures and potential coking.

Figure 7:
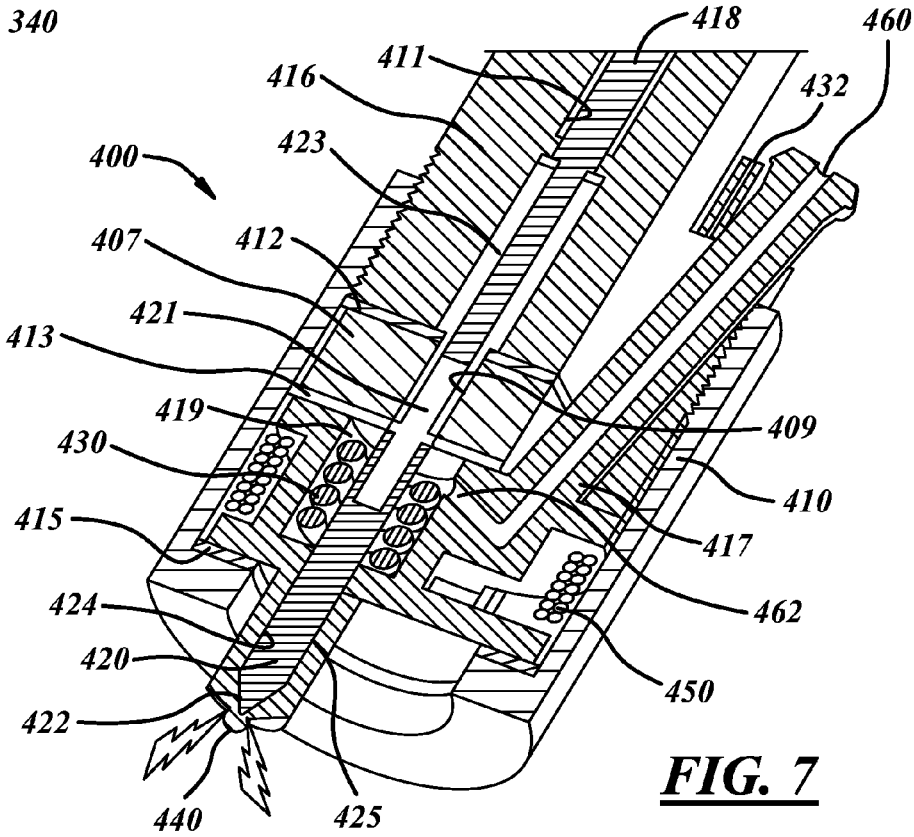
FIG. 7 a cross-sectional view of another embodiment of a fuel injector of the present disclosure utilizing another configuration of induction heating and the electric power transmission through a transformer coil.

Another embodiment of a supercritical injector 400 is shown in FIG. 7 that utilizes electrical induction to raise the temperature of fuel within the injector higher than the supercritical temperature prior to being injected into the combustion chamber. Elements of injector 400 include an upper sleeve body 416 that is threaded or otherwise sealingly connected to a lower housing 410, an intermediate body element 407 and a lower needle housing 417. Upper sleeve body 416 contains a central bore 411 for supporting upper injector needle shaft 418. A hydraulic actuation chamber 423 is below bore 411 to allow unheated fuel to be employed as hydraulic fluid. Unheated fuel is introduced into hydraulic actuation chamber 423 in a conventional manner to assist a conventional electromechanical actuator to operate the movement of injector needle shaft 418 at predetermined portions of the injection cycle. Lower needle housing body 417 is positioned at the lower end of injector 400 and contains a heating chamber 419 that surrounds a lower portion of injector needle 420. Heating chamber 419 receives preheated fuel from a preheating source through fuel passage 460. (See FIGS. 3 and 8 for examples of preheating sources.) Fuel passage 460 has an open end 462 that is in communication with heating chamber 419. Grooves or loose spacing 425 between needle 420 and bore 424 in the lower portion of lower needle housing body 417 allow heated fuel from heating chamber 419 to enter spray nozzle portion 440 of injector 400, when needle tip 422 is retracted during its injection cycle.

In this embodiment induction heating of fuel to its supercritical state is achieved by the use of a primary transformer coil 450 mounted between lower housing 410 and lower needle housing body 417. Induction coil 430 mounted within heating chamber 419 surrounds needle 420. Primary transformer coil 450 is connected to wires 432. When connected to an electrical source, via wires 432, primary transformer coil 450 generates an electrical field that induces heat in the portion of injection needle 420 that is within heating chamber 419. Induction frequency in the range of 4 kHz has been found to provide adequate heating. Primary transformer coil 450 also induces current to flow in induction coil 430 and because of impedance in induction coil 430, provides additional heat to fuel within heating chamber 419. Fuel within heating chamber 419 and forced alongside needle 420 towards nozzle 440 in grooves or spacing 425 is heated by its contact with the outer surface of needle 420 to its supercritical state just before it reaches spray nozzle portion 440.

An insulator 421 is contained within needle 420 that is disposed within bore 409 to resist the migration of energy from the lower part of needle 420 that is subjected to induction heating to the upper portion. Other insulating sheaves 412, 413 and 415 (in a non-limiting example, ceramic) are provided between body and housing elements to help contain the heating necessary to place the fuel in its supercritical state.

Figure 8:
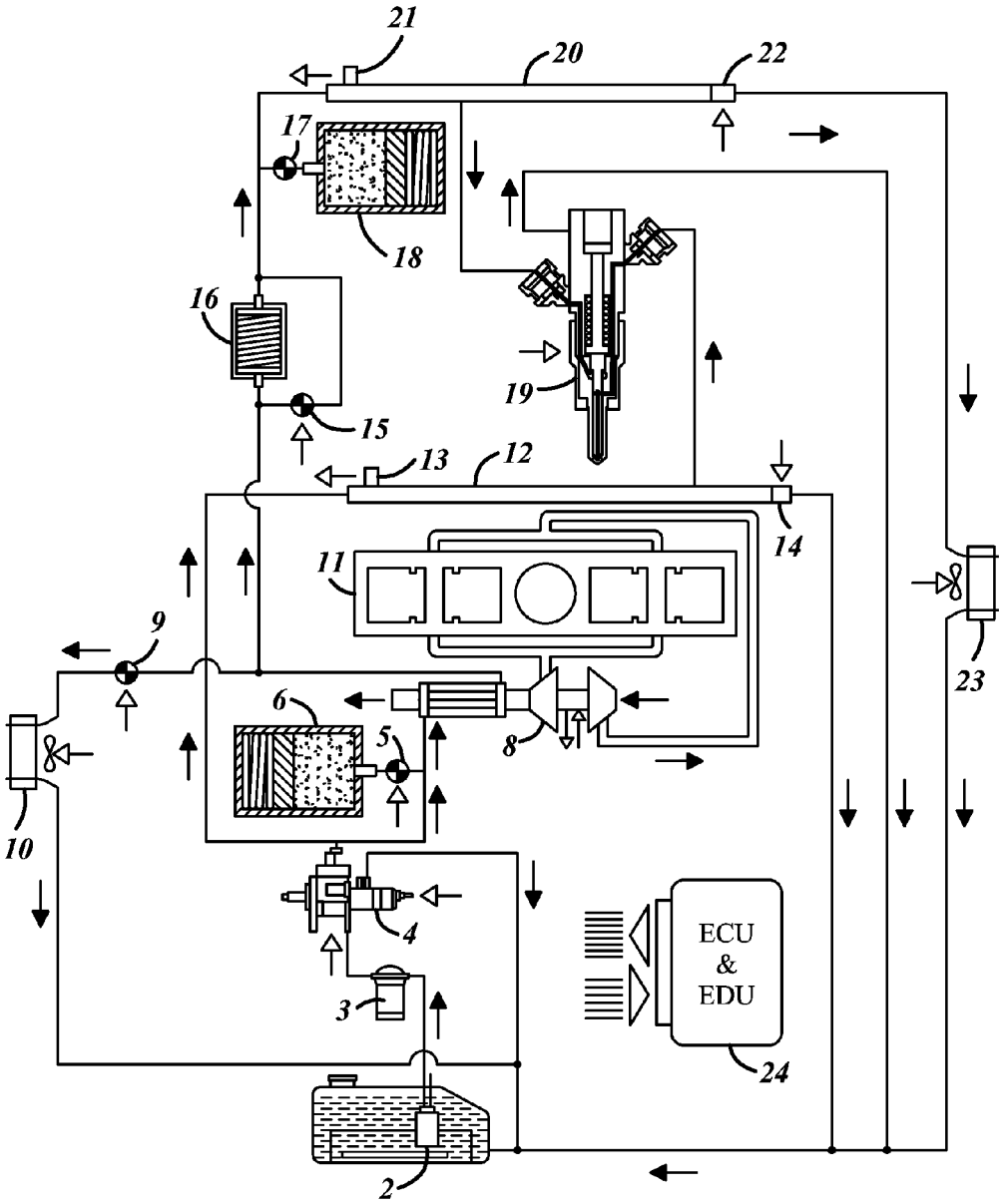
FIG. 8 is a schematic representation of a fuel supply/injector system.

The supercritical-state fuel injection system of FIG. 8 is shown in association with an opposed-piston, opposed-cylinder engine 11 of the type shown and disclosed in the above "incorporated by reference" patents. A fuel tank 1 includes a lift pump 2 which provides fuel, under comparatively low pressure and at ambient temperature, through a fuel filter 3 to the input port of a high pressure fuel pump 4. The fuel pump 4 provides fuel at high pressure and ambient temperature to a low temperature common rail 12 for distribution to the hydraulic portion of each fuel injector 19 (although only one injector 19 is shown, it is understood that at least one injector, port or combustion chamber mounted, is provided per cylinder). Fuel pump 4 also provides fuel at high pressure and ambient temperature to a normally closed and electrically controlled high pressure valve 5 that is in series with an insulated high pressure accumulator 6. The fuel pump 4 further provides fuel at high pressure and ambient temperature to an exhaust gas heat exchanger 7 for preheating to a temperature that is below the temperature at which the fuel reaches its supercritical state. Excess fuel related to fuel pump 4 returns to fuel tank 1.

Exhaust gas heat exchanger 7 lies in the exhaust gas path exiting the engine 11 and the turbine of a turbocharger 8. In this example, turbocharger 8 is electrically controlled with an electric motor on its shaft between the compressor and the turbine. The preheated fuel exiting exhaust gas heat exchanger 7 is fed to a high temperature common rail 20 where it is distributed the fuel injectors such as the one shown as injector 19 where it is heated to its supercritical state for injection into the combustion chamber of engine 11. Prior to reaching the common rail, the preheated and high pressure fuel flows through a high-pressure, insulated, latent-enthalpy, storage device 16 that is in parallel with a bypass line controlled by an electrically-controlled and normally open valve 15. Upon leaving the parallel junction above 15 and 16, a normally closed electrically controlled valve 17 sits in series with an insulated high pressure accumulator 18. The unused fuel exiting high temperature common rail 20 is allowed to be bled off by an electrically controlled regulator 22 to a cooling heat exchanger 23 before is returned to tank 1. Pressure sensor 21 is used to monitor the pressure in high temperature common rail 20 and provide information to the electronic control unit 24 ("ECU"). Similarly, pressure sensor 13 senses pressure and regulator 14 bleeds off fuel in low temperature common rail 12. The preheated fuel exiting exhaust gas heat exchanger 7 is also fed, in parallel, to a normally-closed electrically-controlled valve 9 that is in series with a cooling heat exchanger 10.

The system components shown in FIG. 8 serve the normal function of providing hydraulic actuation fuel to fuel injector 19 and also provide preheated fuel to be injected into the combustion chamber of an internal combustion engine. This is especially important when combined with an injector or injectors of the type which raise the fuel temperature to the supercritical state. In addition, the system provides heated fuel storage for assisting in cold starting and flushing of high temperature fuel from components susceptible to coking when the engine operation is stopped.

During engine operation, valve 5 is initially opened to allow high pressure and ambient temperature fuel from high pressure pump to enter insulated high pressure accumulator 6 (a spring loaded piston in an insulated chamber) and to be stored therein until valve 5 is again opened, after engine shut down. At the time of engine shut down, valve 5 is again opened and the relatively cooled fuel in accumulator 6 flows through exhaust gas heat exchanger 7 and purges the heated fuel. This lowers the temperature of the fuel present in exhaust gas heat exchanger 7 below 500° C., depending on the fuel blend containing some portion of oxygenated hydrocarbons—a point where coking is not an issue. The hot fuel purged from heat exchanger 7 exits the system through opened valve 9.

At the time of engine start up, it is desirable to have some degree of fuel preheating for the fuel to be placed in its supercritical state prior to injection. Achieving a supercritical state early retains the fuel efficiency of the system while keeping NOx emissions low. The system depicted in FIG. 8 achieves that goal by using high-pressure, insulated, latent-enthalpy storage device 16 and insulated high-pressure accumulator 18. Both components are set to receive preheated high-pressure fuel immediately upon shut down of the engine by opening valve 17 for a predetermined period of time and closing valve 17. At the time of engine shut down, there is still some residual flow of preheated fuel in the high pressure system. Closing valve 15 causes residual fuel to flow into latent-enthalpy storage device 16 which is shown as a coil of tubing inside an insulated container. The preheated fuel remains in latent enthalpy storage device 16 until the engine is again started. Also, preheated fuel is stored in insulated high-pressure accumulator 18 during this shut down period by opening valve 17 for a predetermined period of time.

At the time of the next engine start up, valve 17 is again opened and prior to the high-pressure pump delivering preheated fuel to the common rail 20 and the injector 19, the fuel then in storage device 16 and high-pressure accumulator 18 are forced towards common rail 20 and injector 19. Whatever energy remains in the stored fuel becomes a benefit during this start up period.

Some components of diesel fuels are known to coke at higher temperatures. In particular, aromatics and olefins are prone to undergo chemical reactions, in the absence of oxygen, that lead to the formation of hydrocarbon components that adhere to surfaces. In particular, it is the double carbon-to-carbon bonds that are particularly reactive. After a period of time, the buildup of the coking materials can impair the performance of the injector system.

To limit the ability of the coking hydrocarbons from adhering to the internal surfaces of the injector, the injector may be coated with a material to limit such buildup, by interfering with the chemical reactions that form the coke and/or making the surface less hospitable to adherence. Gold, platinum, palladium, and titanium are materials that help to resist buildup of coking materials. Thus, in one embodiment, any surfaces downstream of the heater that raises fuel temperature to the supercritical state have one or more of the above-listed materials on their surface. In the case of the induction heater, the chamber in which the induction heater is located and everything downstream is coated. In the case of the glow plugs external to the injector, the chamber in which the glow plugs are located and all components downstream are coated.

In one embodiment, chemicals that interrupt the reaction paths leading to coking materials are provided to the fuel. Two such chemicals are hydrogen peroxide and methanol, both of which contain oxygen. By oxygenating the reactive double carbon-to-carbon bonds, the reaction mechanisms are altered thereby producing less of the coking materials.

Another embodiment to address the coking issue is for the injector tip to protrude into the combustion chamber, as shown in FIG. 3. In such an embodiment, the fuel is heated upstream of the injector tip to a temperature just below the supercritical temperature. By virtue of the tip being exposed to combustion gases, it is hotter than other portions of the injector and can act to further raise the temperature of the fuel at the tip to a temperature above the supercritical state. In one embodiment, measures are taken to insulate the injector tip from the rest of the injector, such as provided by insulators 314 and 415 in FIGS. 6 and 7, respectively. Referring now to FIG. 3, in another embodiment, an insulator 190 is provided between the injector and an orifice in the cylinder head into which it is installed. Since the cylinder head is typically water cooled, the proximity of the injector to the cylinder head may act to cool the injector if no such insulation were provided.

While the best mode has been described in detail, those familiar with the art will recognize various alternative designs and embodiments within the scope of the following claims. Where one or more embodiments have been described as providing advantages or being preferred over other embodiments and/or over background art in regard to one or more desired characteristics, one of ordinary skill in the art will recognize that compromises may be made among various features to achieve desired system attributes, which may depend on the specific application or implementation. These attributes include, but are not limited to: efficiency, direct cost, strength, durability, life cycle cost, packaging, size, weight, serviceability, manufacturability, ease of assembly, marketability, appearance, etc. The embodiments described as being less desirable relative to other embodiments with respect to one or more characteristics are not outside the scope of the disclosure as claimed.

What is claimed:

1. A fuel injection system, comprising:

a fuel injector having a heating system that raises the temperature of the fuel above the supercritical state wherein the heating system comprises an induction heater within the injector; and an electrically-valved, insulated fuel storage device for storing high pressure fuel that has been preheated during the period the internal combustion engine is turned off, and for delivering the stored fuel to the injector at the time of the next start up of the internal combustion engine.

2. The system of claim 1 wherein the fuel injector has a chamber upstream of a spray nozzle and a reciprocating needle; in an open position of the needle, fluidic communication between the spray nozzle and the chamber is allowed; in a closed position of the needle, fluidic communication between the spray nozzle and the chamber is substantially prevented; and the induction heater is located within the chamber.

3. The system of claim 2 wherein the chamber contains an electrical coil and the fuel is heated to its supercritical state by induction heating of the needle and the electric power being transmitted via an external transformer coil.

4. The system of claim 1, further comprising: an exhaust gas heat exchanger providing an exchange between fuel and exhaust gas and located upstream of the fuel injector wherein the fuel is raised to a temperature below the supercritical state within the exhaust gas heat exchanger.

5. The system of claim 1 wherein the fuel injector has a chamber upstream of a spray nozzle and the glow plug is electrically energized to raise the temperature of fuel entering the chamber to its supercritical state.

6. The system of claim 1 wherein the fuel injector is coupled to a cylinder of an opposed-piston, opposed-cylinder engine.

7. A method for operating a direct-injection, internal combustion engine, comprising:

elevating the temperature of fuel injected into a combustion chamber of the engine above a supercritical temperature by one of a glow plug located immediately upstream of a fuel injector coupled to the combustion chamber and an induction heater provided within a chamber in the fuel injector; and storing heated, pressurized fuel in an insulated fuel storage device upon engine shutdown; and delivering heated, pressurized fuel from the insulated fuel storage device to the fuel injector upon engine restart.

8. The method of claim 7, further comprising:

monitoring pressure in a fuel rail located upstream of the fuel injector; and bleeding off fuel when pressure in the fuel rail exceeds a desired pressure.

9. The method of claim 7 wherein an exhaust gas heat exchanger providing an exchange between fuel and exhaust gas is located upstream of the fuel injector to raise fuel temperature below the supercritical state within the exhaust gas heat exchanger.

10. A system for injecting supercritical state fuel into a combustion chamber of an internal combustion engine, comprising:

a fuel injector having a reciprocating needle and a needle housing surrounding the needle;

the needle housing including a fuel injection spray nozzle;

a chamber in the fuel injector in which the fuel is heated to its supercritical state;

an exhaust gas heat exchanger located upstream of the fuel injector and in which the fuel is preheated to a temperature below its supercritical state; and an electrically-valved, fuel storage device for storing high pressure fuel that has not been preheated, and for delivering the stored fuel to the high temperature heat exchanger following operation of the internal combustion engine to cool the fuel remaining in the heat exchanger to prevent coking.

11. The system of claim 10, wherein the chamber contains an electrical coil and the fuel is heated to its supercritical state by induction heating of the needle.

12. The system of claim 10, wherein the chamber contains an electrical coil and the fuel is heated to its supercritical state by induction heating of the needle and the electric power being transmitted via an external transformer coil.

13. The system of claim 10, wherein the chamber contains a glow plug that is electrically energized to raise the temperature of fuel entering the chamber to its supercritical state.

14. The system of claim 10, further comprising: a high pressure fuel pump disposed upstream of the exhaust gas heat exchanger.

15. The system of claim 14, further comprising: an electrically-valved, insulated fuel storage device for storing high pressure fuel that has been preheated during the period the internal combustion engine is turned off, and for delivering the stored fuel to the injector at the time of the next start up of the internal combustion engine.

16. A fuel injection system, comprising:

a fuel tank;

a fuel injector;

a fuel line between the fuel tank and the fuel injector;

an exhaust gas heat exchanger in thermal communication with the fuel line in which fuel is raised to a temperature below the supercritical temperature;

at least one of an induction heater within the injector and a glow plug disposed in the fuel line coupled to the fuel injector and located immediately upstream of the fuel injector to raise the fuel temperature above the supercritical state; and an electrically-valved, fuel storage device for storing high pressure fuel that has not been preheated, and for delivering the stored fuel to the high temperature heat exchanger following operation of the internal combustion engine to cool the fuel remaining in the heat exchanger to prevent coking.

17. The fuel injection system of claim 16 wherein the fuel injector is coupled to a combustion chamber of an internal combustion engine; and a tip of the injector protrudes into the combustion chamber to be heated by combustion gases in the combustion chamber.

18. The fuel injection system of claim 17, further comprising: an insulator between the fuel injector and the combustion chamber.

19. The fuel injection system of claim 17, further comprising: an insulator provided in the fuel injector between a tip of the injector and a body of the injector.

20. The fuel injection system of claim 16 wherein fuel system components in contact with fuel hotter than the supercritical state have at least one of: gold, platinum, palladium, and titanium provided on the surfaces of such fuel system components.

21. The fuel injection system of claim 1 further comprising: a glow plug disposed in an inlet line coupled to the fuel injector where the glow plug is located immediately upstream of the fuel injector.

* * * * *